US007182705B2

(12) United States Patent
Lin

(10) Patent No.: US 7,182,705 B2
(45) Date of Patent: Feb. 27, 2007

(54) AUTOMATED TEE-BALL SERVER APPARATUS FOR HITTING A BALL

(75) Inventor: Chiu Yuan Lin, Hsien (TW)

(73) Assignee: Tianjin Golden Rubber Product Corporation (TW)

( * ) Notice: Subject to any disclaimer, the term of this patent is extended or adjusted under 35 U.S.C. 154(b) by 0 days.

(21) Appl. No.: 10/899,362

(22) Filed: Jul. 26, 2004

(65) Prior Publication Data

US 2006/0019774 A1 Jan. 26, 2006

(51) Int. Cl.
*A63B 69/00* (2006.01)
*A63B 71/00* (2006.01)

(52) U.S. Cl. ..... 473/417; 473/451

(58) Field of Classification Search ..... 473/417, 473/422, 419, 451, 431, 131–137, 420; 124/6, 124/16, 54

See application file for complete search history.

(56) References Cited

U.S. PATENT DOCUMENTS 5,297,797 A * 3/1994 Lamontagne ..... 473/133
5,672,124 A * 9/1997 Pecoraro et al. ..... 473/417
5,848,945 A * 12/1998 Miller et al. ..... 473/417
6,416,429 B1 * 7/2002 Pecoraro et al. ..... 473/417
6,695,723 B2 * 2/2004 Leal et al. ..... 473/417
6,719,649 B1 * 4/2004 Lin ..... 473/417
6,875,136 B2 * 4/2005 Leal et al. ..... 473/451
6,926,623 B2 * 8/2005 Lin ..... 473/417

* cited by examiner

*Primary Examiner*—Mitra Aryanpour
(74) *Attorney, Agent, or Firm*—Ezra Sutton, Esq.

(57) ABSTRACT

A tee-ball server apparatus for conducting batting practice wherein the apparatus supplies a ball to a ball receiving seat member so the batter may swing a bat in order to hit the ball. The tee-ball server apparatus includes a movable rod having the ball receiving seat member thereon, with the movable rod being movable between a retracted position and an extended position within a server housing. The tee-ball server apparatus further includes a worm gear assembly for driving the movable rod between the retracted position and the extended position for receiving a ball on the ball receiving seat member to be hit; and a ball supply chute assembly is disposed adjacent to the server housing for supplying balls to the ball receiving seat member on the movable rod for the batter to hit the ball.

18 Claims, 5 Drawing Sheets

AUTOMATED TEE-BALL SERVER APPARATUS FOR HITTING A BALL

FIELD OF INVENTION

The present invention relates to an automated tee-ball server apparatus for hitting a ball. More particularly, it relates to a tee-ball server apparatus having a delivery mechanism for automatically delivering a ball to a predetermined height onto a ball seat member in order for the user to hit the ball from the tee-ball server apparatus.

BACKGROUND OF THE INVENTION

Baseball is a popular sport and exercise in many countries such as the United States, Mexico, Canada, Cuba, Dominican Republic, Haiti, Venezuela, and Japan. Usually a baseball game must be played by nine baseball players per team. If only one person desires to play baseball, a problem arises of not having at least a pitcher, a catcher and a batter (hitter) for batting practice by a player. To overcome this problem in the prior art, a baseball server for a single user was developed to eliminate the need for a pitcher and a catcher. In one prior art patent, the baseball server throws a baseball which has a flying path simulating the traveling path of the baseball from a pitcher. However, this prior art baseball server needs a larger area for use, so that it is inconvenient for many users.

Another problem occurs when a user plays batting practice in a self-batting format with no mechanical equipment involved, wherein the batter throws a baseball upwards and then hits the baseball with a bat. The flight path of the baseball will be affected by the behavior of the batter such that the flight path of the baseball is either unfair or beneficial to the batter and does not represent a proper swinging movement by the batter. Moreover, after the baseball is thrown upward, the user must then hold and swing the bat quickly, often missing the thrown upward and arching baseball. This time period is too short for the batter to react quickly for a proper swinging movement.

There remains a need for a tee-ball server apparatus having a delivery mechanism for automatically delivering a ball to a predetermined height onto a ball seat member in order for the batter to hit the ball from the tee-ball server apparatus. The tee-ball server apparatus should also include means for actuating a movable rod within a server housing in order to move the ball to the predetermined height on the ball seat member.

The prior art does not disclose or teach such a tee-ball server apparatus using a novel delivery mechanism for automatically delivering a ball to a predetermined height for a batter to swing at the ball.

Accordingly, it is an object of the present to provide a tee-ball server apparatus having a delivery mechanism for moving a movable rod between a retracted position and an extended position to a predetermined height onto a ball seat member in order to hit a ball from the tee-ball server apparatus.

Another object of the present invention is to provide a tee-ball server apparatus having a worm gear assembly for propelling and moving the movable rod in an upward direction such that the batter is able to adequately swing the bat in order to hit the ball from the tee-ball server apparatus at an appropriate height.

Another object of the present invention is to provide a tee-ball server apparatus having a worm gear assembly for actuating a movable rod within a server housing in order to move the ball in an upward direction from a ball receiving seat member.

Another object of the present invention is to provide a tee-ball server apparatus that is simple to use, requires only a limited space, is easy to maintain, and is capable of withstanding everyday wear and tear.

A still further object of the present invention is to provide a tee-ball server apparatus that can be mass produced in an automated and economical manner and is readily affordable by the consumer.

SUMMARY OF THE INVENTION

In accordance with the present invention, there is provided a tee-ball server apparatus for conducting batting practice wherein the apparatus includes a ball chute for supplying balls to a ball receiving seat member so the batter may swing a bat in order to hit the ball. The tee-ball server apparatus includes a movable rod having the ball receiving seat member thereon, with the movable rod being movable between a retracted position and an extended position within a server housing. The tee-ball server apparatus further includes a worm gear assembly for driving the movable rod between the retracted position and the extended position for receiving a ball on the ball receiving seat member to be hit; and the ball supply chute assembly is disposed adjacent to the server housing for supplying balls to the ball receiving seat member on the movable rod for the batter to hit the ball.

BRIEF DESCRIPTION OF THE DRAWINGS

Further objects, features and advantages of the present invention will become apparent upon the consideration of the following detailed description of the presently-preferred embodiment when taken in conjunction with the accompanying drawings, wherein.

DETAILED DESCRIPTION OF THE PREFERRED EMBODIMENT

Figure 1:
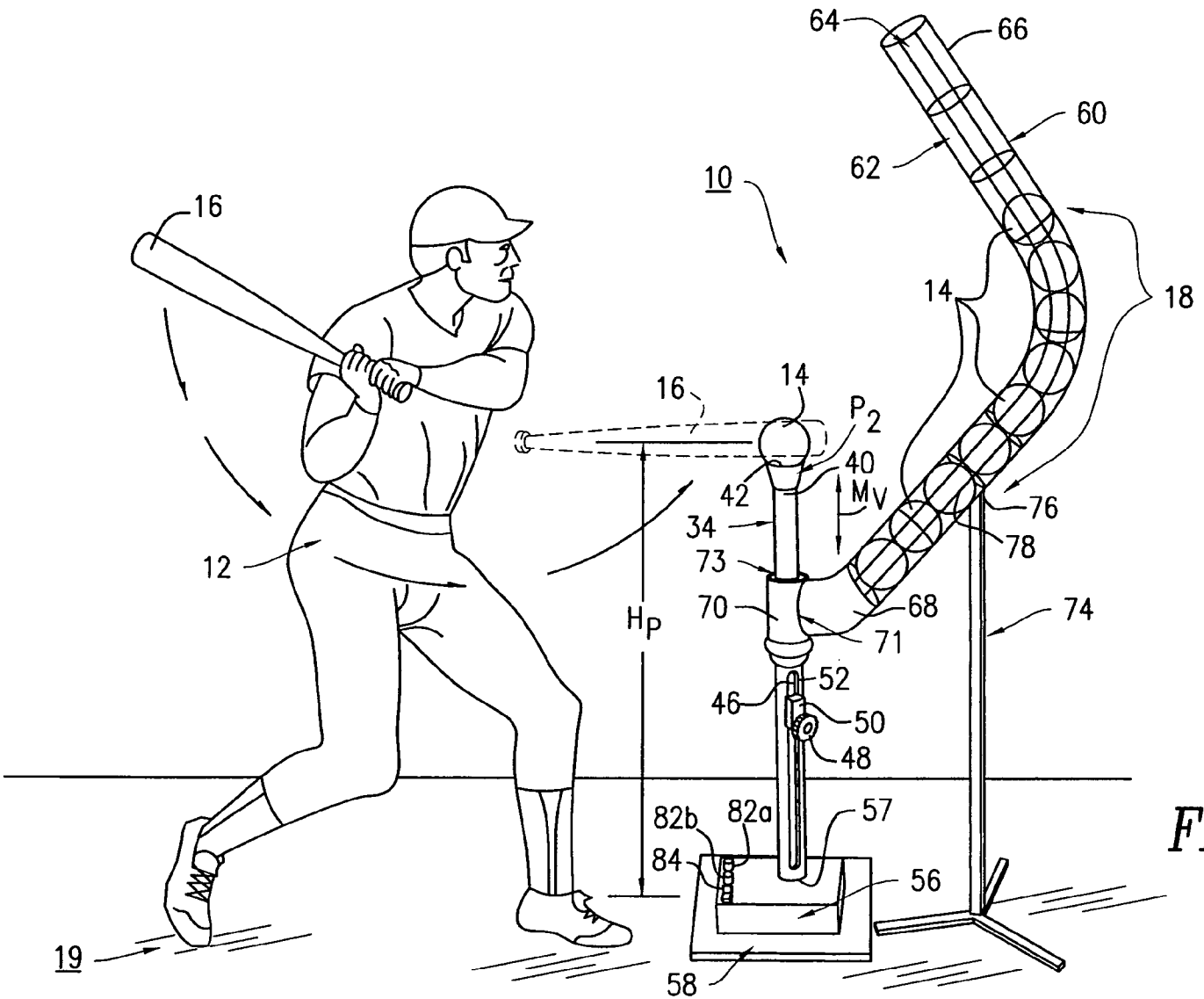
FIG. 1 is a perspective view of the tee-ball server apparatus of the preferred embodiment of the present invention showing the tee-ball server apparatus in an assembled state and in operational use thereof by a single batter.

The automated tee-ball server apparatus 10 and its component parts of the preferred embodiment of the present invention are represented in detail by FIGS. 1 through 7 of the patent drawings. The automated tee-ball server apparatus 10 is used for batting practice by a single batter 12 swinging and hitting a ball 14 by a bat 16 at a predetermined $H_p$ relative to the field/ground/courtyard 19, as depicted in FIG. 1 of the drawings. It should be understood that the term ball is intended to include a baseball, a softball, a hardball, a tennis ball, a rubber ball, a wiffle ball, a paddle ball, a hand ball and the like.

Figure 2:
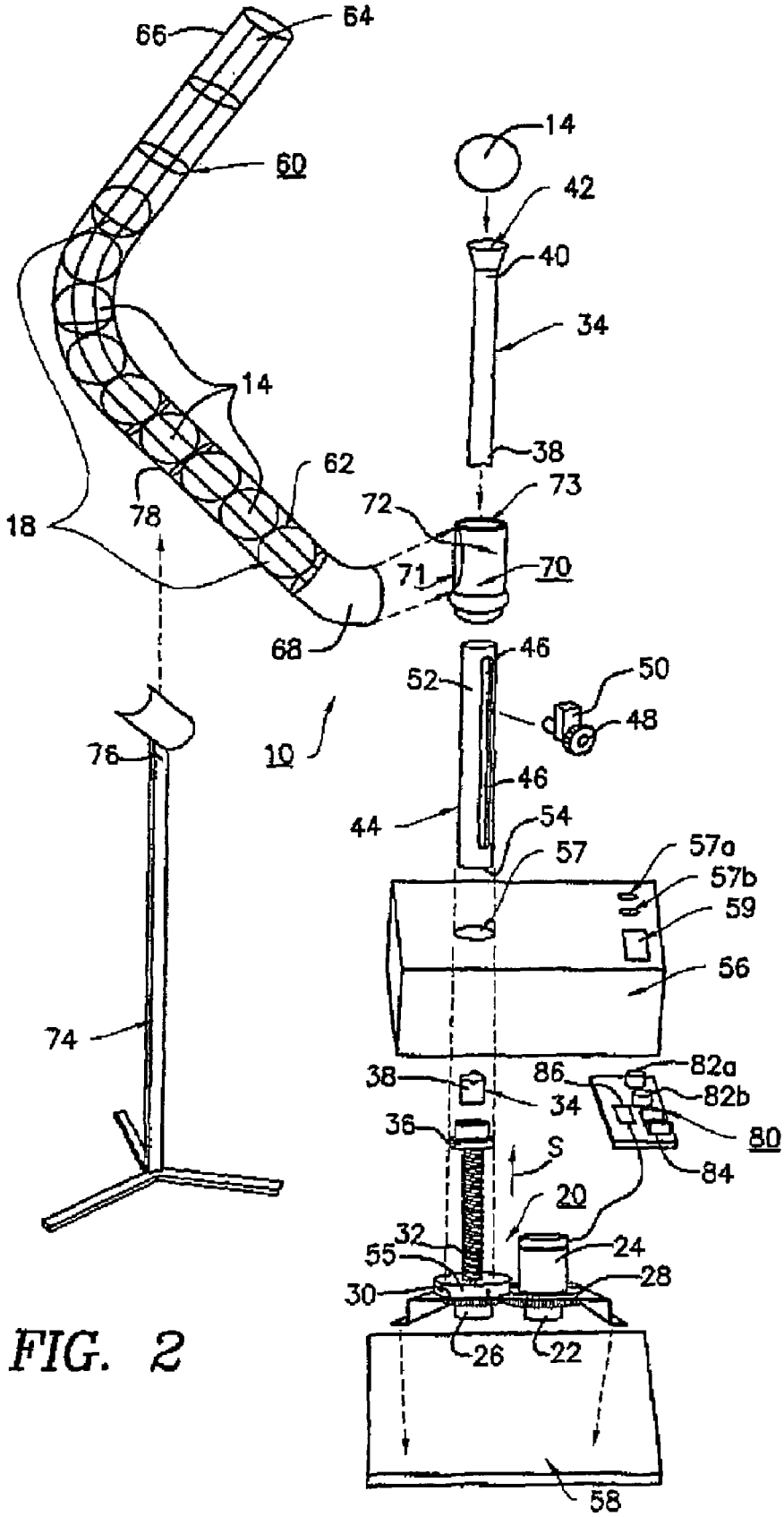
FIG. 2 is an exploded perspective view of the tee-ball server apparatus of the present invention showing a ball receiving seat member and a movable rod connected to a worm gear assembly.
Figure 3:
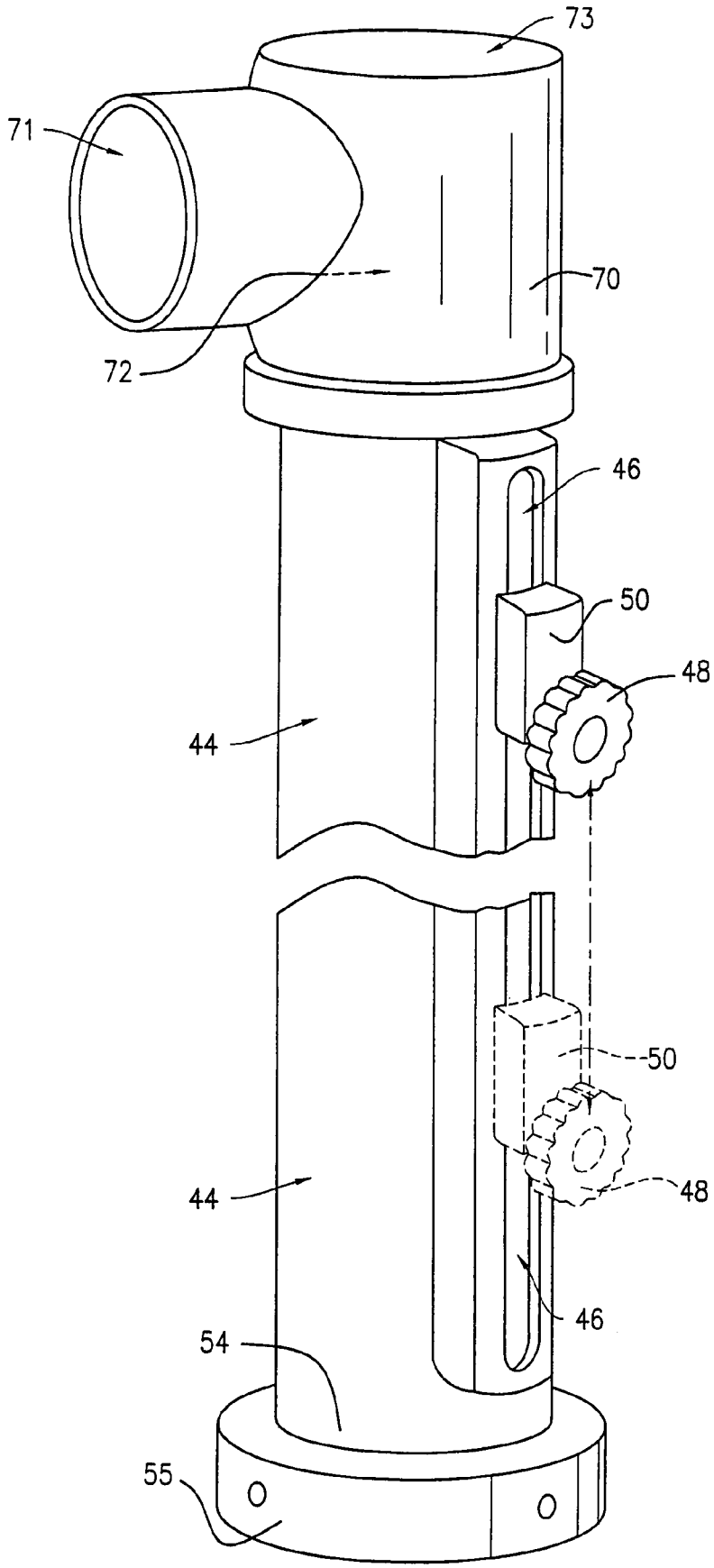
FIG. 3 is a perspective view of the tee-ball server apparatus of the present invention showing the server housing having a vertical slotted channel with an adjustment knob therein.
Figure 6:
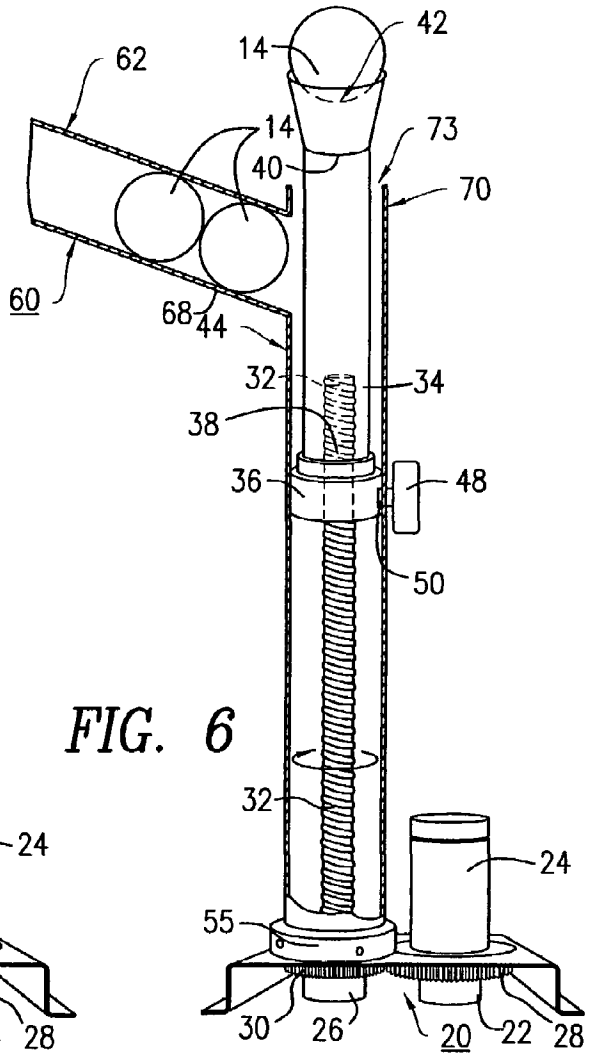
FIG. 6 is a sectional view of the tee-ball server apparatus of the present invention showing the ball on the ball receiving seat member with the movable rod in its extended position.
Figure 4:
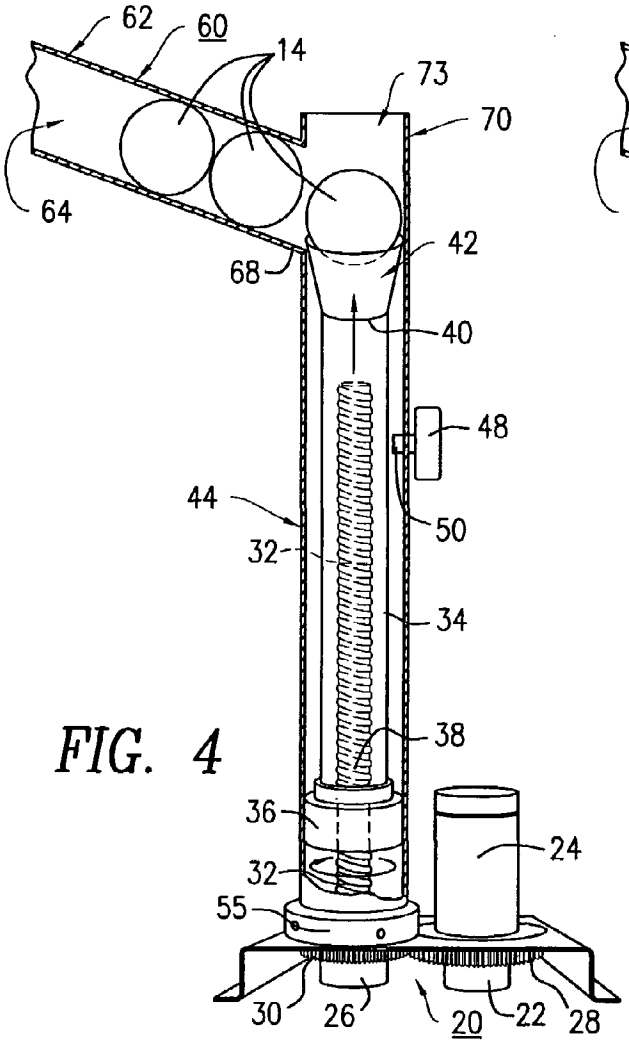
FIG. 4 is a sectional view of the tee-ball server apparatus of the present invention showing a ball being received on the ball receiving seat member and the movable rod being moved in an upward direction.

As shown in FIGS. 1 to 6, the automated tee-ball server apparatus 10 of the present invention includes a worm gear assembly 20 for adjusting the height $H_p$ of ball 14 relative to the swinging stance of the single batter 12 when hitting the ball 14 with the bat 16 (see FIG. 1). The worm gear assembly 20 includes a first drive shaft 22 connected to a motor 24, a second drive shaft 26 interconnected to the first drive shaft 22 by meshed gears 28 and 30. Drive shaft 22 includes a worm drive shaft 32 connected to a movable rod 34 by a shaft connector member 36. Movable rod 34 has a proximal end 38 and a distal end 40. At the distal end 40 is a ball receiving seat member 42. The movable rod 34 moves between a retracted position $P_1$ and an extended position $P_2$ in order to raise the movable rod 34 to a predetermined height $H_p$, as depicted in FIGS. 1, 4 and 6 of the patent drawings.

Drive shaft 22, worm drive shaft 32, movable rod 34 and shaft connector member 36 are all disposed within a cylindrical server housing 44. Server housing 44 includes a vertical slotted channel 46 having an adjustment control knob 48 connected to an adjustment sensor switch member 50 for adjusting the height $H_p$ of the vertical movement $M_V$ of movable rod 34. Further, server housing 44 includes an upper end 52 and a lower end 54. The lower end 54 of server housing 44 is detachably connected to a server housing attachment member 55, as shown in FIGS. 3 and 4 of the drawings. The worm gear assembly 20 is housed within a worm gear housing 56 having an opening 57 for receiving server housing 44 therethrough. Additionally, worm gear housing 56 includes a pair of control knob openings 57*a* and 57*b* for receiving a pair of speed and time control knobs 82*a* and 82*b* therethrough. Worm gear housing 56 also includes a power switch opening 59 for receiving a push button on-off switch 84 therethrough, as shown in FIGS. 1 and 2 of the drawings. The worm gear assembly 20 is held in place on a base member 58, as shown in FIGS. 2 and 3 of the drawings. Base member 58 includes a circuit board 86 for housing and holding of the speed and time control rheostat knobs 82*a* and 82*b*, the on-off switch 84 and a circuit chip 86 for the electrical connecting of the speed and time control rheostat knobs 82*a* and 82*b* and on-off switch 84 for electrically connecting to the motor 24, as shown in FIGS. 1 and 2.

Figure 5:
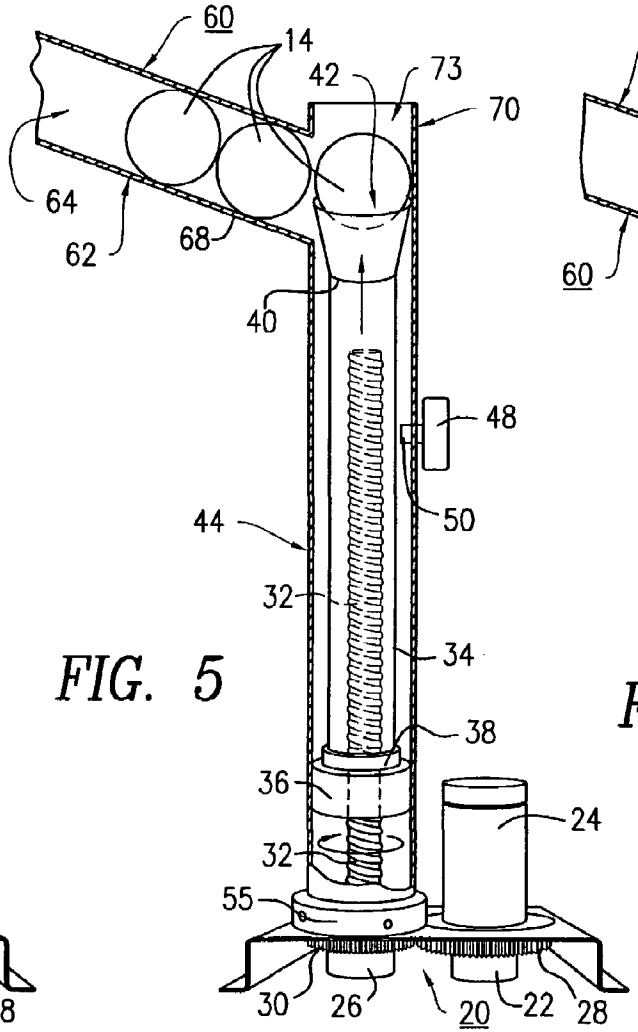
FIG. 5 is a sectional view of the tee-ball server apparatus of the present invention showing the ball being moved upward through a chute connector member by the movable rod.

A ball supply chute 60 is disposed adjacent to the upper end 52 of server housing 44, which supplies balls 14 to the ball receiving seat member 42 when the movable rod 34 moves to its extended position $P_2$, as depicted in FIGS. 2, 4 and 6 of the drawings. Chute 60 includes a flexible cylindrical housing 62 having an interior storage compartment 64 for holding a stack 18 of balls 14 therein. Flexible housing 62 includes a proximal end 66 and a distal end 68. Ball supply chute 60 further includes a chute connector member 70 having a ball chute opening 71 for receiving balls 14 therethrough. Chute connector member 70 also includes an interior chamber 72 for receiving a single ball 14 therein. The distal end 68 of the flexible housing 62 is detachably connected to the ball chute opening 72, as shown in FIGS. 1 to 3, for receiving balls 14 therethrough. The chute connector member 70 also includes a server housing opening 73 for receiving the server housing 44 therethrough, as shown in FIGS. 4, 5 and 6 of the drawings. Additionally, the ball supply chute 60 includes a stand member 74 having an upper end 76. The upper end 76 of the stand member 74 is detachably connected to a central location 78 on the flexible cylindrical housing 62, as depicted in FIGS. 1 and 2 of the drawings, in order to have the ball supply chute 60 oriented in an upstanding manner for receiving a stack 18 of balls 14 through the interior storage compartment 64.

Figure 7:
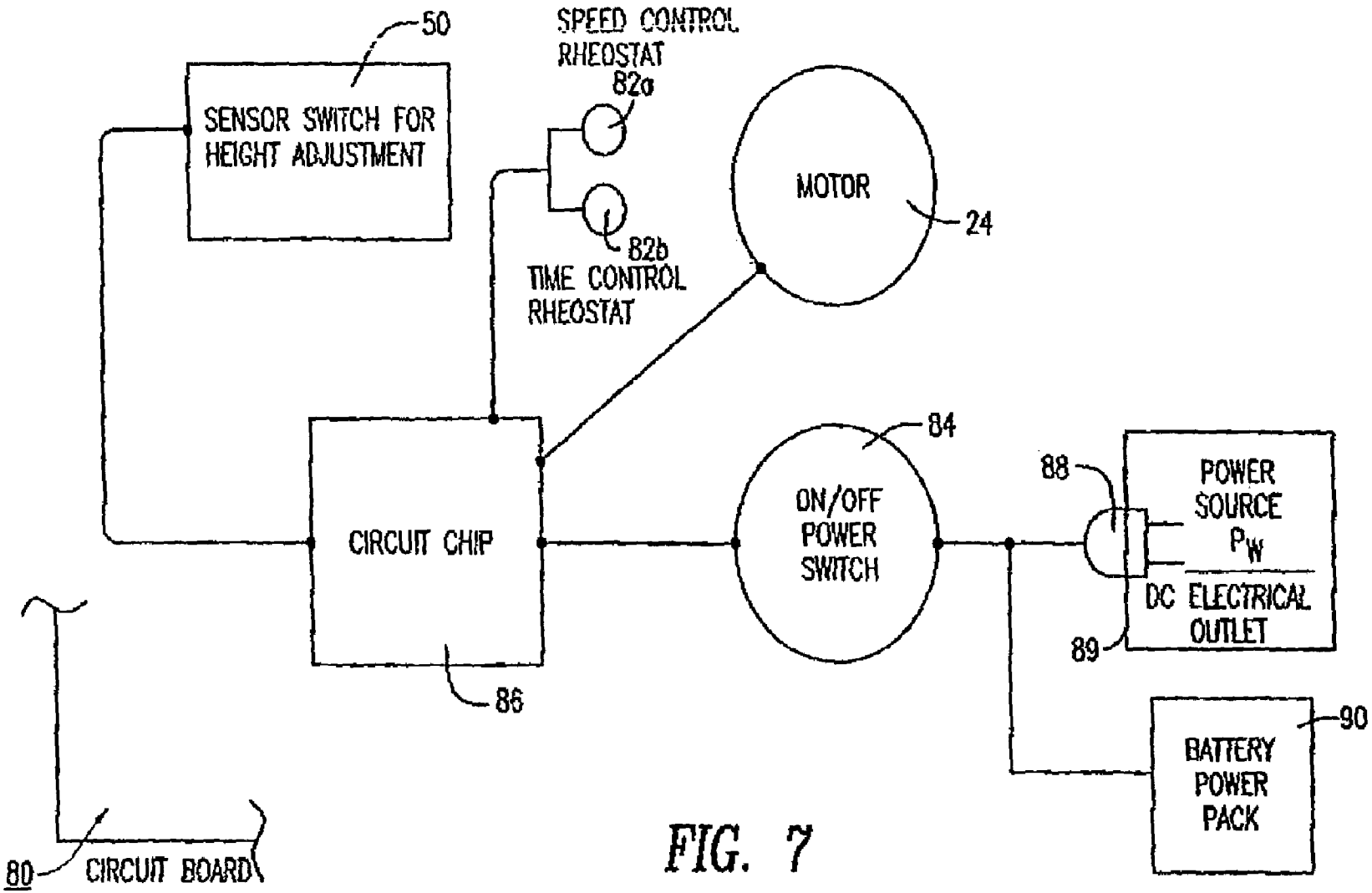
FIG. 7 is an electrical schematic diagram of the tee-ball server apparatus of the present invention showing the electrical connections of a power switch, an adjustment height sensor switch, a speed control knob, a time control knob, a motor and an electrical circuit board for electrically connecting to each of the other electrical components.

As shown in the electrical schematic diagram of FIG. 7, the circuit board 86 holds the speed and time control knobs 82*a* and 82*b* (rheostat elements), the on-off switch 84 and the circuit chip 86. The circuit chip 86 is electrically connected to the sensor switch adjustment member 50, to the speed and time control knobs 82*a* and 82*b*, to the on-off switch 84, and to the motor 24, as shown in FIG. 7. The on-off power switch 84 is electrically connected to a power source $P_w$ via electrical wire and plug 88 to a standard DC electrical outlet 89 or to a battery power pack 90.

Operation of the Present Invention

In assembling the tee-ball server apparatus 10, as shown in FIGS. 1 to 3 of the drawings, the user initially attaches the distal end 68 of the flexible housing 62 of ball supply chute 60 to the ball chute opening 72 of chute connector member 70. The user now attaches the upper end 76 of stand member 74 to the central location point 78 on flexible housing 62. In this manner, the ball supply chute 60 is oriented in an upright manner for receiving a stack 18 of balls 14 through the interior storage compartment 64 of flexible housing 62, as shown in FIG. 1 of the drawings. The stack 18 of balls 14 will now slide down the ball supply chute 60 because of the chute's tilted angle. One of the balls 14 of stack 18 is then seated in the ball receiving seat member 42, as depicted in FIG. 4. Seat member 42 on movable rod 34 is positioned initially at the upper end 52 of server housing 44. The user/player now adjusts the adjustment control knob 48 and the adjustment member (sensor switch) 50 in order to raise and position the movable rod 34 to an extended position $P_2$ which orients the ball receiving seat member 42 to a proper and predetermined height $H_p$. Before activation of the tee-ball server apparatus 10, the user now sets the speed of the height movement of movable rod 34 and time control segment between batting swings via the speed control and time control knobs 82*a* and/or 82*b*, respectively. The time control segment is set between 15 seconds to 60 seconds via the time control rheostat knob 82*b*. The user now also sets the adjustment height control knob 48 for the setting of a predetermined height $H_p$ of movable rod 34 to its extended position $P_2$. This appropriate height $H_p$ relative to the field 19 allows the single batter 12 to practice a correct swinging stance for hitting ball 14 by bat 16, as shown in FIG. 1. The movable rod 34 moves automatically via the worm gear assembly 20 to its extended position $P_2$.

The user now turns "ON" the push button power switch 84 for activating the tee-ball server apparatus 10, as shown in FIG. 1. This activation then operates motor 24 to turn meshed gears 28 and 30, respectively, allowing the movement of worm drive shaft 32 to spin slowly in an upward direction S. The shaft connector member 36 and movable rod 34 will also be driven in an upward direction, thus raising the seated ball 14. The ball will be raised upward until the edge of the shaft connector member 36 reaches the sensor switch adjustment member 50 of control knob 48. The sensor switch adjustment member 50 now cuts off the power source $P_w$ of motor 24, stopping the movement of movable rod 34 to its predetermined height $H_p$. Ball 14 is now at its designated height $H_p$ in which the batter 12 hits the ball 14 with a bat 16 during a batting practice. Regardless of the player's 12 choice to hit or not hit the ball 14 from the server apparatus 10, the motor 24 will be reactivated after a designated time that was set by the time control knob 82*b*, whereby the shaft connector member 36 and movable rod 34 move downwardly to its original and initial position to accept another ball 14 from the ball chute 60 onto seat member 42, if necessary. The server apparatus 10 is then reactivated to start again the aforementioned steps based on the previous settings on the speed and time control knobs 82*a* and 82*b*, respectively, and sensor switch adjustment member 50 for the player 12 to hit the next seated ball 14 by bat 16.

ADVANTAGES OF THE PRESENT INVENTION

Accordingly an advantage, of the present is that it provides for a tee-ball server apparatus having a delivery mechanism for moving a movable rod between a retracted position and an extended position to a predetermined height onto a ball seat member in order to hit a ball from the tee-ball server apparatus.

Another advantage of the present invention is that it provides for a tee-ball server apparatus having a worm gear assembly for propelling and moving the movable rod in an upward direction such that the batter is able to adequately swing the bat in order to hit the ball from the tee-ball server apparatus at an appropriate height.

Another advantage of the present invention is that it provides for a tee-ball server apparatus having worm gear assembly for actuating a movable rod within a server housing in order to move the ball in an upward direction from a ball receiving seat member.

Another advantage of the present invention is that it provides for a tee-ball server apparatus that is simple to use, requires only a limited space, is easy to maintain, and is capable of withstanding everyday wear and tear.

A still further advantage of the present invention is that it provides for a tee-ball server apparatus that can be mass produced in an automated and economical manner and is readily affordable by the consumer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A tee-ball server apparatus for conducting batting practice wherein the apparatus supplies a ball to a ball receiving seat and the batter swings a bat in order to hit the ball, comprising:

a) a movable rod having a ball receiving seat member thereon, said movable rod being movable between a refracted position and an extended position within a server housing;

b) a worm gear assembly for driving said movable rod between said retracted position and said extended position for receiving a ball on said ball receiving seat member to be hit;

c) a ball supply chute assembly being disposed adjacent to said server housing for supplying balls to said ball receiving seat member on said movable rod for the batter to hit a ball;

d) said worm gear assembly includes a first drive shaft connected to a motor and a second drive shaft interconnected to said first drive shaft by a pair of cooperating meshed gears;

e) said first drive shaft includes a worm drive shaft connected to said movable rod by a shaft connector member;

f) said server housing is cylindrically-shaped and said first drive shaft, said shaft connector members aid worm drive shaft and said movable rod are all disposed within said cylindrically-shaped server housing; and g) said cylindrically-shaped server housing includes a vertical slotted channel having an adjustment knob connected to an adjustment sensor switch member for controlling and adjusting said predetermined height of the vertical movement of said movable rod.

2. A tee-ball server apparatus in accordance with claim 1, wherein said movable rod moves between said retracted position and said extended position in order to raise said ball receiving seat member on said movable rod to a predetermined height allowing a single batter to practice a correct swinging stance for hitting a ball by a bat.

3. A tee-ball server apparatus in accordance with claim 1, wherein said movable rod includes a proximal end and a distal end.

4. A tee-ball server apparatus in accordance with claim 3, wherein said distal end of said movable rod includes said ball receiving seat member for holding a single ball thereon.

5. A tee-bail server apparatus in accordance with claim 3, wherein said proximal end of said movable rod are detachably connected to said worm gear assembly.

6. A tee-ball server apparatus in accordance with claim 1, wherein said cylindrically-shaped server housing includes an upper end and a lower end.

7. A tee-ball server apparatus in accordance with claim 6, wherein said upper and lower ends of said server housing includes a server opening for receiving said worm drive shaft and said movable rod therethrough.

8. A tee-ball server apparatus in accordance with claim 6, wherein said lower and of said cylindrically-shaped server housing is detachably connected to a server housing attachment member.

9. A tee-ball sewer apparatus in accordance with claim 1, wherein said ball supply chute assembly includes a flexible cylindrical housing having an interior storage compartment for holding a stack of balls therein.

10. A tee-ball server apparatus in accordance with claim 9, wherein said flexible cylindrical housing includes a proximal end and a distal end, and said proximal end of said flexible housing for receiving the stack of balls through said interior storage compartment.

11. A tee-ball server apparatus in accordance with claim 10, wherein said distal end of said flexible housing is detachably connected to a bail chute opening of a chute connector member for receiving a single ball within an interior chamber of said chute connector member.

12. A tee-ball server apparatus in accordance with claim 9, wherein said ball supply chute assembly further includes a stand member having an upper end, said upper end of said stand member being detachably connected to a central location on said flexible housing of said ball supply chute assembly in order to orient said ball supply chute assembly in an upright manner for receiving the stack of balls through said interior storage compartment.

13. A tee-ball server apparatus in accordance with claim 1, wherein said tee-ball server apparatus includes a base member for stabilizing said apparatus on a playing field.

14. A tee-ball server apparatus in accordance with claim 1, wherein said tee-ball sewer apparatus includes a circuit board for holding a plurality of electrical components thereon.

15. A tee-ball server apparatus in accordance with claim 14, wherein said electrical components on said circuit board include a speed control rheostat knob for controlling the upward and downward movement of said movable rod, a time control rheostat knob for controlling a time period for reactivating the downward movement of said movable rod, an on-off power switch and a circuit chip.

16. A tee-ball server apparatus in accordance with claim 15, wherein said circuit chip is electrically connected to said adjustment sensor switch member, to said speed control rheostat knob, to said time control rheostat knob, to said motor, and to said on-off power switch.

17. A tee-ball server apparatus in accordance with claim 15, where said time control rheostat knob is set between 15 seconds to 60 seconds for said time period.

18. A tee-ball server apparatus in accordance with claim 15, wherein said on-off power switch is electrically connected to a standard DC power source or to a battery power pack.

* * * * *